US012122497B2

(12) United States Patent
Laine et al.

(10) Patent No.: US 12,122,497 B2
(45) Date of Patent: Oct. 22, 2024

(54) METHOD AND A STEERING ARRANGEMENT FOR TURNING A PROPULSION UNIT OF A VESSEL

(71) Applicant: ABB Oy, Helsinki (FI)

(72) Inventors: Jukka Laine, Helsinki (FI); Jussi Kiiskilä, Helsinki (FI); Ville Suoranta, Helsinki (FI)

(73) Assignee: ABB Oy, Helsinki (FI)

( * ) Notice: Subject to any disclaimer, the term of this patent is extended or adjusted under 35 U.S.C. 154(b) by 47 days.

(21) Appl. No.: 17/660,858

(22) Filed: Apr. 27, 2022

(65) Prior Publication Data

US 2022/0388622 A1 Dec. 8, 2022

(30) Foreign Application Priority Data

Jun. 2, 2021 (EP) ..... 21177316

(51) Int. Cl.
*B63H 25/24* (2006.01)
*B63H 5/125* (2006.01)

(52) U.S. Cl.
CPC ..... *B63H 25/24* (2013.01); *B63H 5/125* (2013.01); *B63H 2005/1258* (2013.01)

(58) Field of Classification Search
CPC . B63H 25/24; B63H 5/125; B63H 2005/1258
See application file for complete search history.

(56) References Cited

U.S. PATENT DOCUMENTS

2010/0292876 A1* 11/2010 Mizutani ..... B63H 21/22 701/21

FOREIGN PATENT DOCUMENTS

EP 1119486 A1 8/2001
WO 2020147967 A1 7/2020

OTHER PUBLICATIONS

European Search Report; Application No. EP 21 17 7316; Issued: Nov. 19, 2021; 2 Pages.

* cited by examiner

*Primary Examiner* — Andrew Polay
(74) *Attorney, Agent, or Firm* — Whitmyer IP Group LLC

(57) ABSTRACT

An arrangement including a gearwheel connected to the propulsion unit, a steering electric motor operatively connected to the gearwheel and controlled by a drive, a force transmission arrangement including a clutch between the gearwheel and the steering electric motor, and a measurement unit for measuring rotational motion positioned at each side of the clutch. The steering electric motor is arranged to rotate the gearwheel and thereby also the propulsion unit. A difference in the output signals of the two measuring units indicating slipping of the clutch is detected. The steering electric motor is controlled to at least reduce the difference in the output signals when the difference exceeds a predetermined threshold.

21 Claims, 3 Drawing Sheets

METHOD AND A STEERING ARRANGEMENT FOR TURNING A PROPULSION UNIT OF A VESSEL

FIELD

The present invention relates to a method and a steering arrangement for turning a propulsion unit of a vessel.

BACKGROUND

External propulsion units are used more and more today especially in big vessels. The propulsion unit may extend outwards from a hull of a vessel. The propulsion unit may comprise a hollow strut with an upper portion and a lower portion.

The upper portion of the strut may form a support arm supporting the lower portion of the strut. The support arm may extend outwards from the hull of the vessel.

The lower portion of the strut may form a longitudinal compartment. A propeller shaft may be rotatably supported within the compartment. At least one propeller may be provided on one outer end or on both outer ends of the propeller shaft. The propeller or propellers are thus positioned outside the axial ends of the lower portion of the strut. The propeller shaft may be driven by a driving motor positioned in the lower portion of the strut or in the upper portion of the strut or within the vessel. The driving motor may be an electric motor.

An upper end of the upper portion of the strut may be attached to a gearwheel positioned within the hull of the vessel. The gearwheel may be turned 360 degrees around a centre axis of rotation with at least one steering electric motor. The at least one steering electric motor may be connected operatively via a force transmission arrangement to the gearwheel to turn the gearwheel and thereby the propulsion unit.

External loads caused by e.g. ice, big wave shocks, a bottom contact, or vibrations may produce a torque on the propulsion unit. These external loads may cause an external turning torque on the propulsion unit counteracting the turning torque produced by the steering electric motor. There is a risk that the force transmission e.g. the cogs in the force transmission may brake due to the heavy loads.

SUMMARY

An object of the present invention is an improved steering arrangement for turning a propulsion unit of a vessel and in improved method for controlling a steering arrangement for turning a propulsion unit of a vessel.

The steering arrangement for turning a propulsion unit of a vessel is defined in claim 1.

The method for controlling a steering arrangement for turning a propulsion unit of a vessel is defined in claim 13.

The maximum torque that acts on the propulsion unit and the transmission in fast overload situations may be limited by a clutch arranged in the force transmission arrangement between the gearwheel and the steering electric motor.

The electric motor may in such fast overload situations produce a big torque on the propulsion unit and the force transmission due to the big moment of inertia of the electric motor. When the propulsion unit is turned with a high torque (an over torque situation), due to an external force acting on the propulsion unit, the inertia of the steering electric motor is multiplied through the planetary gear by a factor of $g^2$, where g is the gear ratio of the planetary gear. The gear ratio of a steering electric motor is also high. The inertia and thus the counter torque from the steering electric motor becomes so high that the force transmission may in some cases brake.

The clutch in the force transmission will, however, in an overload situation start to slip eliminating the over torque situation in the force transmission. The slipping of the clutch must, however, be limited to a rather short time-period to prevent the clutch from excess wearing and/or overheating.

The clutch may be set to slip when a predetermined threshold torque produced by an external force acting on the propulsion unit is exceeded.

The inventive steering arrangement provides a way of handling an over-torque situation without damages to the force transmission arrangement and especially to the clutch in the force transmission arrangement.

This is done by monitoring rotational motion of the steering electric motor with a first measuring unit and rotational motion of the force transmission after the clutch with a second measuring unit. The output signals of the two measuring units are monitored to detect a difference in the output signals of the measuring units. Said difference in the output signals of the two measuring units indicates slipping of the clutch. The steering electric motor may then be controlled to at least reduce the difference in the outputs of the two measuring units when the difference in the outputs of the two measuring units exceeds a predetermined threshold. The steering electric motor may advantageously be controlled to eliminate the difference in the outputs of the two measuring units.

The difference in the output signals of the two measuring units indicates that the clutch is slipping. Slipping of the clutch indicates that an external force is acting on the propulsion unit. The torque needed to turn the propulsion unit increases above a certain threshold due to the external force acting on the propulsion unit. A reduction of the difference in the outputs signals of the two measuring units makes it possible for the clutch to reconnect i.e. the slipping may be stopped.

A reduction of the difference in the output signals of the two measuring units may as a first alternative be realized so that the rotation speed of the steering electric motor is set to be the substantially the same as the rotation speed of the force transmission arrangement after the clutch. The substantially equal speed at both sides of the clutch may be maintained for a predetermined time-period after which the control of the steering electric motor may return to normal operation. The predetermined time-period may be determined so that the clutch will have enough time to reconnect during said predetermined time-period.

A reduction of the difference in the output signals of the two measuring units may as a second alternative be realized so that the torque of the steering electric motor is dropped to zero. The torque of the steering electric motor may be dropped to zero for a predetermined time-period. The steering electric motor is thus free to rotate along with the rotation of the gearwheel during said predetermined time-period. The clutch will have enough time to reconnect during said predetermined time-period. The control of the steering electric motor may then after the predetermined time-period return to normal operation.

The situation may in both alternatives be such that the external load is still acting on the propulsion unit when the control of the steering electric motor returns to normal operation. A difference in the output signals of the two measuring units will thus still occur when the control of the steering electric motor returns to normal operation. The control of the steering electric motor will then again start to reduce the difference in the output signals of the two measuring units.

The inventive arrangement will thus protect the clutch from overheating and thereby from braking.

The inventive arrangement makes it also possible to realize a condition monitoring of the steering arrangement.

The condition of the steering arrangement may in a first alternative be done by calculating the slipping cycles of the clutch based on the information of the rotational motion measured by the two measuring units. The condition of the clutch may be determined based on the number of slipping cycles. The condition of the clutch may further be indicated. The indication of the condition of the clutch may be done either locally at the site of the steering arrangement or at some remote location in which case data transfer is needed. The condition of the clutch in the steering arrangement may thus be monitored.

The condition of the steering arrangement may in a second alternative be done by calculating the twist of the clutch and/or the shaft in the force transmission based on the information of the rotational motion measured by the two measuring units. The calculated twist may then be compared to the twist of a new steering assembly measured earlier to determine a possible difference. In case the calculated twist exceeds the twist of a new steering assembly, when considering a certain tolerance, a need to replace critical parts in the steering arrangement may be indicated. The indication of the condition of the clutch may be done either locally at the site of the steering arrangement or at some remote location in which case data transfer is needed. The condition of the clutch and/or the shaft of the force transmission may thus be monitored.

The expression stating that a first part is "operatively connected" to a second part means in this application that the first part and the second part may be either connected directly or they may be connected indirectly. The first part and the second part may thus be connected indirectly through a third part or through several third parts. The feature "operatively connected" means that power can be transmitted through the connection between the parts.

DRAWINGS

In the following the invention will be described in greater detail by means of preferred embodiments with reference to the attached drawings, in which.

DETAILED DESCRIPTION

Figure 1:
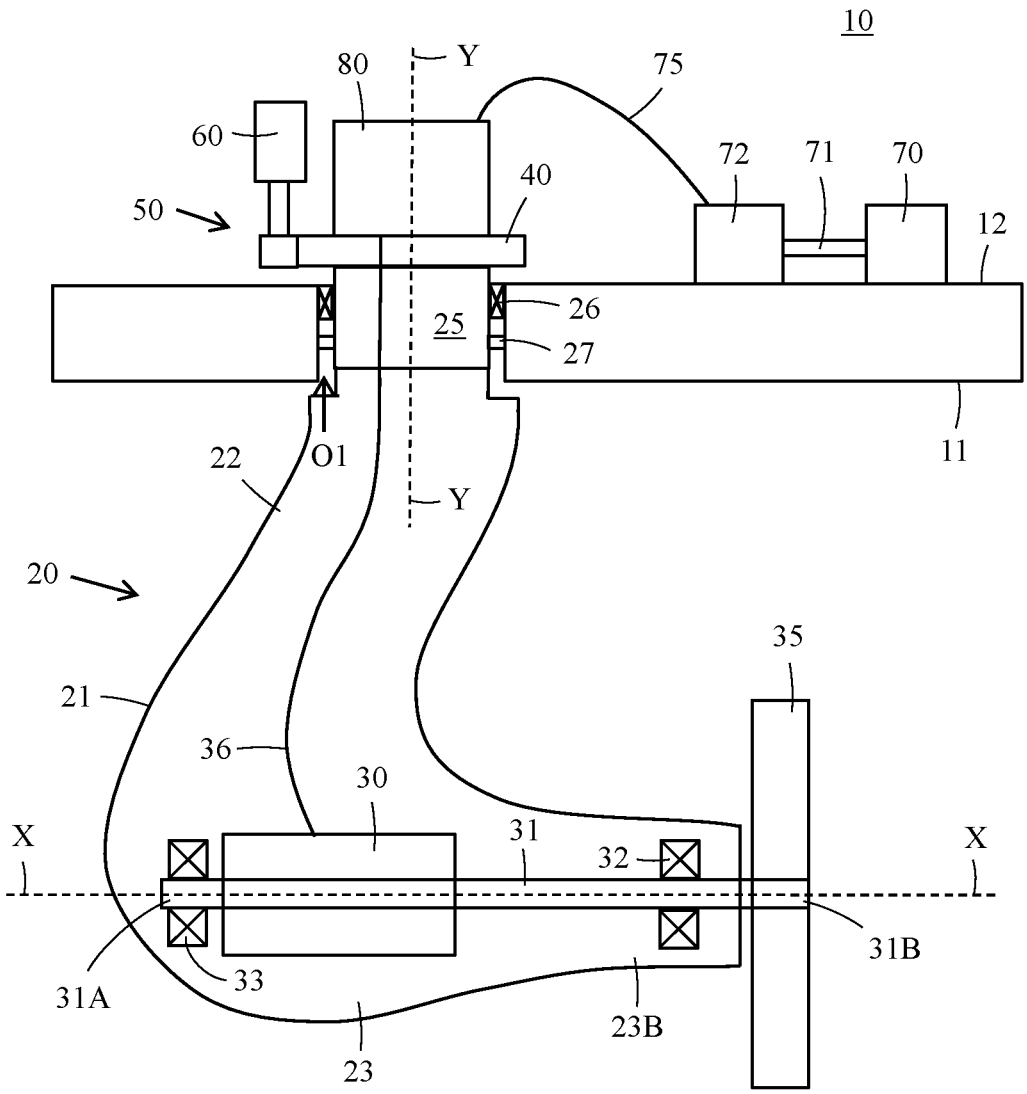
FIG. 1 shows a cross section of a propulsion unit of a vessel.

FIG. 1 shows a vertical cross section of a propulsion unit of a vessel. The vessel 10 may have a double bottom i.e. a first outer bottom 11 forming the hull of the vessel and a second inner bottom 12. The propulsion unit 20 may extend outwards from a hull of the vessel 10. The propulsion 20 unit may comprise a hollow strut 21 with an upper portion 22 and a lower portion 23. The upper portion 22 of the strut 21 may form a support arm supporting the lower portion 23 of the strut. The support arm 22 may extend outwards from the hull of the vessel 10.

The upper portion 22 of the strut 21 of the propulsion unit 20 may be connected to a support cylinder 25. The support cylinder 25 may pass through an opening O1 formed in the bottom of the vessel 10. The opening O1 may extend between the first outer bottom 11 and the second inner bottom 12 of the vessel 10. The support cylinder 25 may be rotatably attached with a slewing bearing 26 to the hull of the vessel 10. The support cylinder 25 could, instead of being a separate entity as is shown here, be formed as an integral portion of the upper portion 22 of the strut 21. The support cylinder 25 would thus form an upper end portion of the upper portion 22 of the strut 21. A slewing seal 27 may be positioned under the slewing bearing 26 in order to prevent leakage of hydraulic fluid from the slewing bearing 26 to the sea and sea water from penetrating into the interior of the hull of the vessel 10 through the passage between the rotating support cylinder 25 and the inner circumference of the opening O1.

The lower portion 23 of the strut 21 may form a longitudinal compartment. The compartment may comprise a propeller shaft 31 comprising a first end 31A and a second end 31B. The propeller shaft 31 may be rotatably supported with bearings 32, 33 within the lower portion 23 of the strut 21. The axial centre line X-X of the propeller shaft 31 may form a shaft line. At least one end 31B of the propeller shaft 31 may protrude out from an end of the lower portion 23 of the strut 21. The end of the propeller shaft 31 that protrudes out from the lower portion 23 of the strut 21 may be sealed with a water seal in the shaft opening in the lower portion 23 of the strut 21. At least one propeller 35 may be connected to the outer end 31B of the propeller shaft 31. The propeller shaft 31 may on the other hand also protrude from both ends of the lower portion 23 of the strut 21. A propeller 35 may thus be positioned on both ends of the propeller shaft 31. The propeller shaft 31 could naturally also be provided with several propellers 35 on each end 31A, 31B of the propeller shaft 31. The propeller shaft 31 is driven by a driving motor 30. The driving motor 30 may be positioned within the lower portion 23 of the strut 21 or within the upper portion 22 of the strut 21 or within the vessel 10. The driving motor 30 may in case it is positioned in the lower portion 23 of the strut 21 be directly connected to the propeller shaft 31. The driving motor 30 may in case it is positioned in the upper portion 22 of the strut 21 or within the vessel be connected via a vertical shaft to the propeller shaft 31. The driving motor 30 may be a driving electric motor 30.

A gearwheel 40 may be positioned within the hull 11, 12 of the vessel 10. An upper end of the support cylinder 25 may be attached to the gearwheel 40. The gearwheel 40 may be turned 360 degrees or less around the centre axis Y-Y of rotation with a steering arrangement. This means that the propulsion unit 20 may be turned 360 degrees around the centre axis of rotation Y-Y. The centre axis of rotation Y-Y may extend in the vertical direction or it may be inclined in relation to the vertical direction. The steering arrangement may comprise at least one steering electric motor 60 rotating the gearwheel 40 through a force transmission arrangement 50. There may be several e.g. four similar steering electric motors 60 connected through a respective force transmission arrangement 50 to the gearwheel 40. The turning of the gearwheel 40 will turn the propulsion unit 20. The gearwheel 40 may have an annular form with a hole in the middle. The gearwheel 40 may be provided with cogs on the outer or inner perimeter of the gearwheel 40. The cogs of the gearwheel 40 are connected to respective cogs in the force transmission arrangement 50.

A prime mover 70 and a generator 72 may be positioned within the vessel 10. The generator 72 may be connected via a shaft 71 to the prime mover 70. The prime mover 70 may be a combustion engine or any other suitable engine for driving the generator 72. The generator 72 produces electric energy needed within the vessel 10 and within the propulsion unit 20. There may be several prime movers 70 and generators 72 in a vessel 10.

A slip ring arrangement 80 may be arranged within the vessel 10 in connection with the gearwheel 40. Electric power is transferred from the generator 72 to the slip ring arrangement 80 with a first cable 75. Electric power is further transferred from the slip ring arrangement 80 to the driving electric motor 30 with a second cable 36. The slip ring arrangement 80 is needed to transfer electric power between the stationary hull of the vessel 10 and the rotating propulsion unit 20.

Figure 2:
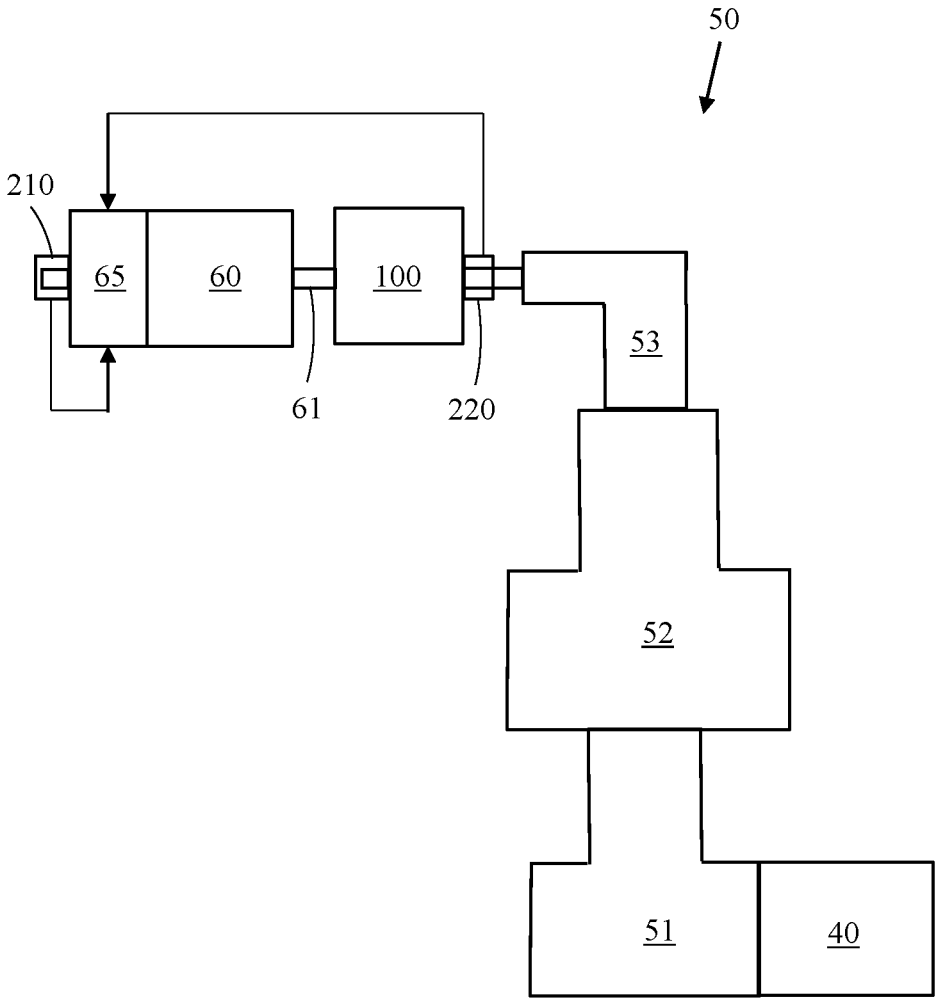
FIG. 2 shows a block diagram of a steering arrangement of a gearwheel.

FIG. 2 shows a block diagram of a steering arrangement of a gearwheel. The steering arrangement comprises a force transmission arrangement 50 arranged between the steering electric motor 60 and the gearwheel 40. The force transmission arrangement 50 may comprise a main pinion gear 51 meshing with the gearwheel 40, a planetary gear 52 connected to the main pinion gear 51, an angle transmission 53 connected to the planetary gear 52, and a clutch 100 connected to the angle transmission 53. The steering electric motor 60 may be connected to the opposite side of the clutch 100 in relation to the angle transmission 53. The steering electric motor 60 may be controlled by a drive 65. The drive 65 may be formed of a frequency converter. A first measuring unit 210 for measuring rotational movement of the steering electric motor 600 may be positioned in connection with the steering electric motor 60. A second measuring unit 220 for measuring rotational movement of the force transmission arrangement 50 after the clutch 100 may be positioned in connection with the force transmission arrangement 50. The second measuring unit 220 may be arranged to measure rotational movement of the force transmission arrangement 50 after the clutch 100 in the force direction of the force transmission arrangement 50. The output of the first measuring unit 210 and the output of the second measuring unit 220 may be connected to the drive 65.

The first measuring unit 210 may be formed of any measuring circuit and/or program code being able to measure rotational movement of the steering electric motor 60. The first measuring unit 210 may measure the rotation speed of the steering electric motor 60 and/or the rotation angle of a shaft 61 of the steering electric motor 60. The first measuring unit 210 may be a rotation detecting sensor measuring the rotation speed and/or the rotation angle of the steering electric motor 60 by measuring the rotation speed and/or the rotation angle of the shaft 61 of the steering electric motor 60. The rotation detecting sensor may be an encoder. The rotation speed and/or the rotation angle of the steering electric motor 60 may on the other hand be measured indirectly from the motor control circuit.

The second measuring unit 220 may be formed of any measuring circuit and/or program code being able to measure rotational movement of the force transmission arrangement 50. The second measuring unit 220 may be a rotation detecting sensor measuring the rotation speed and/or the rotation angle of a shaft in the force transmission arrangement 50. The rotation detecting sensor may be an encoder. The rotation speed and/or the rotation angle of the force transmission arrangement 50 may on the other hand be measured form any point on any rotating part in the force transmission arrangement 50.

The clutch 100, the angle transmission 53, the planetary gear 52 and the main pinion gear 51 transfer power from the steering electric motor 60 to the gearwheel 40 and reduce the rotation speed to a suitable level for rotating the propulsion unit 20. The angle transmission 53 redirects the power distribution by 90 degrees making it possible to have the steering electric motor 60 in a horizontal position. The steering electric motor 60 could, however, also be in a vertical position, whereby the angle transmission 53 could be left out.

The clutch 100 may be used to connect and disconnect the steering electric motor 60 from the gearwheel 40. The clutch 100 may also form a safety device in the force transmission arrangement 50. External forces caused e.g. by ice in the sea might restrict the turning of the propulsion unit 20. The clutch 100 will in such cases slip. Slipping of the clutch 100 will, in abnormal operational conditions, limit the forces acting on the force transmission arrangement 50 and the gearwheel 40.

In normal operational conditions, when the torque produced by external forces on the gearwheel 40 does not exceed a threshold value, the clutch 100 will be closed so that the torque produced by the steering electric motor 60 is transferred via the force transmission 50 to the gearwheel 40.

In abnormal operational conditions, when the torque produced by external forces on the gearwheel 40 exceeds a threshold value, the clutch 100 will slip.

An external force acting on the propulsion unit 20 may be caused e.g. by ice, by big wave shocks, by a bottom contact, or by vibrations. The external force may cause a torque in an opposite direction on the gearwheel 40 in relation to the torque caused by the steering electric motor 60. Slipping of the clutch 100 disconnects the steering electric motor 60 from the gearwheel 40.

Figure 3:
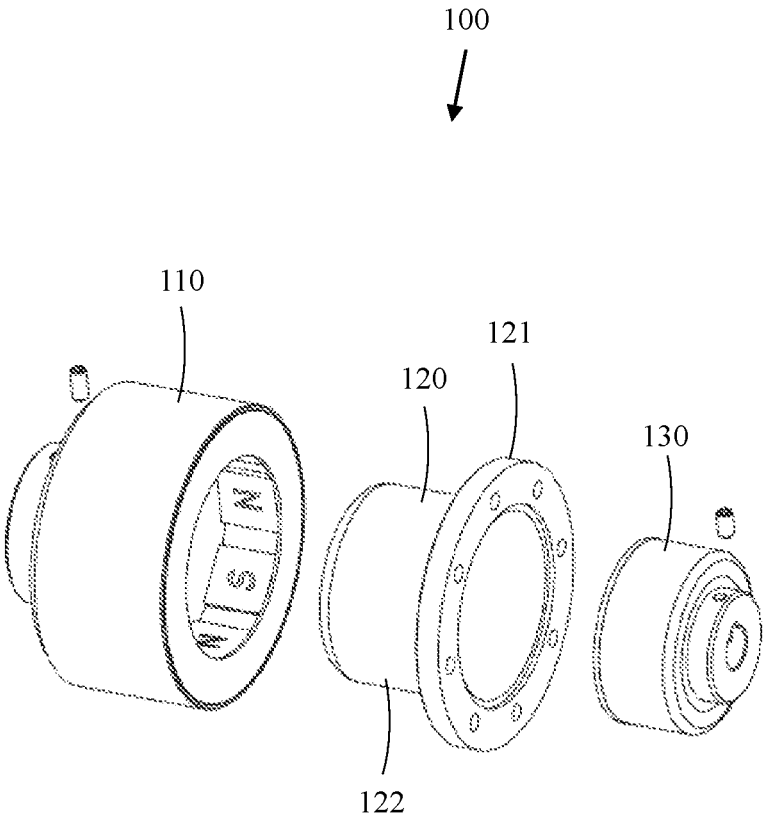
FIG. 3 shows a magnetic clutch.

FIG. 3 shows a magnetic clutch.

The magnetic clutch 100 may comprise an external rotor 110, a containment shroud 120, and an internal rotor 130. The external rotor 110 may have a generally cylindrical form. The containment shroud 120 may comprise an annular flange 121 and a cylindrical portion 122 extending outwards from the flange 121. The cylindrical portion 122 of the containment shroud 120 may be positioned within the external rotor 110 so that the flange 122 is seating against the end surface of the external rotor 110. The containment shroud 120 may be fixedly attached with axial bolts extending through openings in the flange 121 to the end of the external rotor 110. The internal rotor 130 may also have a generally cylindrical form. The internal rotor 130 may be positioned within the containment shroud 120.

The magnetic clutch 100 may be a magnetic particle clutch. A magnetic particle clutch is a special type of electromagnetic clutch which does not use friction plates. Fine powder of magnetically susceptible material, typically steel, is instead used to mechanically connect two rotating parts to each other. The magnetic particle clutch is a form of a powder clutch. Torques is transmitted mechanically through a metal powder filling. In the magnetically controlled version, an applied magnetic field is used to lock the particles in place. Unlike a pure magnetic coupling though, this magnetic field takes no part in transmitting torque magnetically.

The powder forms chains when a magnetic field is applied to the powder. The chains of powder connect the two rotating parts to each other. The strength of the chains depends on the strength of the magnetic field. The powder is free floating when no magnetic field is acting on the powder. The clutch may spin freely without engagement of input shaft to output shaft of the clutch in this free-floating state.

A magnetic coil may be positioned in the external rotor 110. The magnetic powder may be positioned in the cylindrical portion 122 of the containment shroud 120. The internal rotor 130 may be positioned within the containment shroud 120. An electric current flowing in the magnetic coil in the external rotor 110 will produce a magnetic field on the powder in the containment shroud 120. The powder in the containment shroud 120 will form chains due to the magnetic field. The chains of powder will cause a locking between the containment shroud 120 and the internal rotor 130 i.e. between the external rotor 110 and the internal rotor 130.

The operation of the steering arrangement will be explained in the following.

The drive 65 may be configured to monitor the two speeds measured by the two measuring units 210, 220. The drive 65 may monitor the rotational speeds on opposite sides of the clutch 100. The drive 65 may further calculate the difference between the two rotational speeds. The drive 65 may still further be arranged to control the rotational speed of the steering electric motor 60 so that said difference between the two rotational speeds is at least reduced. The drive 65 may preferably be arranged to control the rotational speed of the steering electric motor 60 so that the difference between the two rotational speeds is minimized. A difference between the two rotational speeds measured by the two measuring units 210, 220 indicates that the clutch 100 is slipping. Slipping of the clutch 100 indicates that an external force is acting on the propulsion unit 20. The torque needed to turn the propulsion unit 20 increases above a certain threshold due to the external force acting on the propulsion unit 20. A reduction of the difference in the rotational speeds at opposite sides of the clutch 100 may result in that the clutch 100 reconnects i.e. the slipping stops. The clutch 100 may reconnect when the difference between the rotational speeds at opposite sides of the clutch 100 is reduced to be near zero. The rotational speeds at the opposite sides of the clutch 100 will be equal after the reconnection of the clutch.

A reduction of the difference in the output signals of the two measuring units 210, 220 may as a first alternative be realized so that the drive 65 sets the rotation speed of the steering electric motor 60 to be substantially the same as the rotation speed of the force transmission arrangement 50 after the clutch 100. The substantially equal speed at both sides of the clutch 100 may be maintained for a predetermined time-period after which the control of the steering electric motor 60 may return to normal operation. The predetermined time-period may be determined so that the clutch 100 will have enough time to reconnect during said predetermined time-period.

A reduction in the output signals of the two measuring units 210, 220 may as a second alternative be done so that the drive 65 drops the torque of the steering electric motor 60 to zero for a predetermined time-period. The steering electric motor 60 is thus free to rotate along with the rotation of the gearwheel 40 during said predetermined time-period. The clutch 100 will have enough time to reconnect during said predetermined time-period. The control of the steering electric motor 60 may then after the predetermined time-period return to normal operation. The predetermined time-period during which the torque is zero may be short e.g. less than 10 milliseconds. The torque of the steering electric motor 60 may then be raised when there is no difference in the output signals of two measuring units 210, 220. The total time needed for this operation may be in the order of 0.5 to 1.0 seconds.

The outputs of the measuring units 210, 220 are in the embodiment shown in the figures connected directly to the drive 65. The invention could be realized by a program code in the drive 65. The outputs of the two measuring units 210, 220 could, however, as another alternative be connected to a separate electrical control circuit and the separate electrical control circuit could be connected to the drive 65. The outputs of the measuring units 210, 220 would then be connected indirectly to the drive 65. The separate electrical control circuit would then control the drive 65 based on the output signals of the measuring units 210, 220. The invention could be realized by a program code in the separate electrical control unit. The program codes could be stored in a memory in the drive 65 or in the separate electrical control circuit. The signals in the outputs of the measuring units 210, 200 may be used to control the electric motor 60.

The magnetic clutch 100 shown in FIG. 3 shows one possible clutch 100 that can be used in the invention. The invention is, however, not limited to this kind of clutch 100. Any kind of clutch 100 suitable to be used in the power transmission arrangement 50 may be used in the invention. The clutch 100 should be suitable to control the torque passing through the clutch 100. The clutch 100 should start to slip when a certain predetermined torque is reached. The clutch 100 could be e.g. a friction clutch, an electric clutch, a magnetic clutch, a hydraulic clutch etc. A mechanical spring-loaded ball clutch could be used, wherein in case of overload the ratchet components (balls or rollers) leave their indentations, and a relative motion between the driving and the driven side is generated.

The clutch 100 is in FIG. 2 positioned between the angle transmission 53 and the steering electric motor 60. This is an advantageous embodiment. The clutch 100 could, however, be positioned anywhere in the force transmission arrangement 50 between the gearwheel 40 and the steering electric motor 60.

The measuring units 210, 220 could e.g. be rotary encoders. A rotary encoder is an electromechanical device that converts the angular position or motion of a shaft or axle to analogous or digital outputs. There are two main types of rotary encoders i.e. absolute and incremental encoders. The output of an absolute encoder indicates the current shaft position, making it an angular transducer. The output of an incremental encoder provides information about the motion of the shaft, which typically is processed elsewhere into information such as position, speed, and distance. Mechanical, optical, or magnetic sensors may be used in the rotation speed sensors to detect rotational position changes.

A rotary incremental encoder may have two outputs signals A and B, which issue a periodic digital waveform in quadrature when the encoder shaft rotates. The waveform frequency indicates the speed of the rotating shaft and the number of pulses indicates the distance moved, whereas the A-B relationship indicates the direction of rotation.

The inventive arrangement is not limited to the propulsion unit shown in the figures. The driving electric motor 30 could e.g. be positioned in the upper portion 22 of the strut 21 or in the interior of the vessel 10. A vertical shaft would then be needed to connect the propeller shaft 31 to the driving electric motor 30. A slip ring arrangement 70 would not be needed in case the driving electric motor 30 would be positioned within the interior of the vessel 10.

The invention and its embodiments are not limited to the examples described above but may vary within the scope of the claims.

The invention claimed is:

1. A steering arrangement for turning a propulsion unit of a vessel comprising:

a gearwheel being connected to the propulsion unit, at least one steering electric motor being operatively connected to the gearwheel, a drive for controlling the steering electric motor, a force transmission arrangement comprising a clutch being arranged between the gearwheel and the steering electric motor, wherein the at least one steering electric motor is arranged to rotate the gearwheel and thereby also the propulsion unit via the force transmission arrangement, a first measuring unit for monitoring rotational motion of the steering electric motor, the first measuring unit being a rotation detecting sensor positioned on a shaft between the steering electric motor and the clutch, a second measuring unit for monitoring rotational motion of the force transmission arrangement after the clutch, wherein the output signal of the first measuring unit and the output signal of the second measuring unit are monitored to detect a difference in the output signals indicating slipping of the clutch, the steering electric motor being controlled to at least reduce the difference in the output signals when the difference in the output signals exceeds a predetermined threshold.

2. A steering arrangement for turning a propulsion unit of a vessel comprising:

a gearwheel being connected to the propulsion unit, at least one steering electric motor being operatively connected to the gearwheel, a drive for controlling the steering electric motor, a force transmission arrangement comprising a clutch being arranged between the gearwheel and the steering electric motor, wherein the at least one steering electric motor is arranged to rotate the gearwheel and thereby also the propulsion unit via the force transmission arrangement, a first measuring unit for monitoring rotational motion of the steering electric motor, a second measuring unit for monitoring rotational motion of the force transmission arrangement after the clutch, wherein the output signal of the first measuring unit and the output signal of the second measuring unit are monitored to detect a difference in the output signals indicating slipping of the clutch, the steering electric motor being controlled to at least reduce the difference in the output signals when the difference in the output signals exceeds a predetermined threshold, and wherein the reduction of the difference in the output signals of the two measuring units is realized by setting the rotation speed of the steering electric motor to be substantially the same as the rotation speed of the force transmission arrangement after the clutch.

3. The steering arrangement as claimed in claim 2, wherein the reduction of the difference in the output signals of the two measuring units is realized by setting the rotation speed of the steering electric motor to be substantially the same as the rotation speed of the force transmission arrangement after the clutch for a predetermined time-period after which the control of the steering electric motor is restored to normal operation.

4. The steering arrangement as claimed in claim 1, wherein the reduction of the difference between the output signals of the two measuring units is realized by dropping the torque of the steering electric motor to zero.

5. The steering arrangement as claimed in claim 4, wherein the reduction of the difference between the output signals of the two measurement units is realized by dropping the torque of the steering electric motor to zero for a predetermined time-period after which the control of the steering electric motor is restored to normal operation.

6. The steering arrangement as claimed in claim 1, wherein a condition monitoring of the steering arrangement is realized by calculating the slipping cycles of the clutch based on the information of the rotational motion measured by the two measuring units, the condition of the clutch being determined based on the number of slipping cycles, and the condition of the clutch being indicated.

7. The steering arrangement as claimed in claim 1, wherein a condition monitoring of the steering arrangement is realized by calculating the twist of the clutch and/or the shaft in the force transmission based on the information of the rotational motion measured by the two measuring units, the calculated twist being compared to the twist of a new steering assembly, and indicating a need to replace critical parts in the steering assembly if the twist is without a tolerance of the twist of the new steering assembly.

8. The steering arrangement as claimed in claim 1, wherein the force transmission arrangement between the gearwheel and the steering electric motor comprises a main pinion gear operatively connected to the gearwheel, a planetary gear operatively connected to the main pinion gear, and the clutch operatively connected to the planetary gear and to the steering electric motor.

9. The steering arrangement as claimed in claim 1, wherein the clutch is one of the following: a friction clutch, an electric clutch, a magnetic clutch, a hydraulic clutch.

10. The steering arrangement as claimed in claim 1, wherein the clutch is set to slip when a predetermined threshold torque produced by an external force acting on the propulsion unit is exceeded.

11. The steering arrangement as claimed in claim 1, wherein the propulsion unit comprises a hollow strut with an upper portion and a lower portion, the upper portion being connected operatively to the gearwheel and forming a support arm for the lower portion, the lower portion forming a longitudinal compartment, a propeller shaft being rotatably supported within the compartment, at least one propeller being attached to at least one outer end of the propeller shaft outside the lower portion.

12. A vessel comprising a steering arrangement as claimed in claim 1.

13. A method for controlling a steering arrangement for turning a propulsion unit of a vessel, the steering arrangement comprising:

a gearwheel being connected to the propulsion unit, at least one steering electric motor being operatively connected to the gearwheel, a drive for controlling the steering electric motor, a force transmission arrangement comprising a clutch being arranged between the gearwheel and the steering electric motor, a first measuring unit for monitoring rotational motion of the steering electric motor, a second measuring unit for monitoring rotational motion of the force transmission arrangement after the clutch, the method comprising:

rotating the gearwheel and thereby also the propulsion unit via the force transmission arrangement with the at least one steering electric motor, monitoring the output signals of the two measuring units for detecting a difference between the two output signals indicating slipping of the clutch, controlling the steering electric motor to at least reduce said difference in the output signals of the two measuring units when the difference in the output signals of the two measuring units exceeds a predetermined threshold, wherein said controlling includes setting a rotation speed of the steering electric motor to be substantially the same as a rotation speed of the force transmission arrangement after the clutch when the difference in the output signals of the two measuring units exceeds the predetermined threshold.

14. The method as claimed in claim 13, comprising setting the rotation speed of the steering electric motor to be substantially the same as the rotation speed of the force transmission arrangement after the clutch for a predetermined time-period when the difference in the output signals of the two measuring units exceeds the threshold after which the control of the steering electric motor is restored to normal operation.

15. The steering arrangement as claimed in claim 2, wherein a condition monitoring of the steering arrangement is realized by calculating the slipping cycles of the clutch based on the information of the rotational motion measured by the two measuring units, the condition of the clutch being determined based on the number of slipping cycles, and the condition of the clutch being indicated.

16. The steering arrangement as claimed in claim 2, wherein a condition monitoring of the steering arrangement is realized by calculating the twist of the clutch and/or the shaft in the force transmission based on the information of the rotational motion measured by the two measuring units, the calculated twist being compared to the twist of a new steering assembly, and indicating a need to replace critical parts in the steering assembly if the twist is without a tolerance of the twist of the new steering assembly.

17. The steering arrangement as claimed in claim 2, wherein the force transmission arrangement between the gearwheel and the steering electric motor comprises a main pinion gear operatively connected to the gearwheel, a planetary gear operatively connected to the main pinion gear, and the clutch operatively connected to the planetary gear and to the steering electric motor.

18. The steering arrangement as claimed in claim 2, wherein the clutch is one of the following: a friction clutch, an electric clutch, a magnetic clutch, a hydraulic clutch.

19. The steering arrangement as claimed in claim 2, wherein the clutch is set to slip when a predetermined threshold torque produced by an external force acting on the propulsion unit is exceeded.

20. The steering arrangement as claimed in claim 2, wherein the propulsion unit comprises a hollow strut with an upper portion and a lower portion, the upper portion being connected operatively to the gearwheel and forming a support arm for the lower portion, the lower portion forming a longitudinal compartment, a propeller shaft being rotatably supported within the compartment, at least one propeller being attached to at least one outer end of the propeller shaft outside the lower portion.

21. A vessel comprising a steering arrangement as claimed in claim 2.

* * * * *